US011232742B2

(12) United States Patent
Li et al.

(10) Patent No.: US 11,232,742 B2
(45) Date of Patent: Jan. 25, 2022

(54) METHOD AND APPARATUS FOR REDUCING LED PANEL INTER-CHANNEL INTERFERENCE

(71) Applicant: SCT LTD., Grand Cayman (KY)

(72) Inventors: Eric Li, Milpitas, CA (US); Yi Zhang, Milpitas, CA (US); Shang-Kuan Tang, Milpitas, CA (US); Shean-Yih Chiou, Milpitas, CA (US)

(73) Assignee: SCT LTD., Grand Cayman (KY)

( * ) Notice: Subject to any disclaimer, the term of this patent is extended or adjusted under 35 U.S.C. 154(b) by 0 days.

(21) Appl. No.: 17/202,848

(22) Filed: Mar. 16, 2021

(65) Prior Publication Data

US 2021/0287601 A1 Sep. 16, 2021

Related U.S. Application Data

(60) Provisional application No. 62/990,360, filed on Mar. 16, 2020.

(51) Int. Cl.
*G09G 3/32* (2016.01)

(52) U.S. Cl.
CPC ..... *G09G 3/32* (2013.01); *G09G 2310/0267* (2013.01); *G09G 2310/08* (2013.01)

(58) Field of Classification Search
CPC ..... G09G 3/32; G09G 2310/08; G09G 2310/0267
See application file for complete search history.

(56) References Cited

U.S. PATENT DOCUMENTS

| | | | | |
|---|---|---|---|---|
| 10,517,156 | B1 * | 12/2019 | Qiu | H05B 45/46 |
| 2012/0187762 | A1 * | 7/2012 | Kim | H03K 7/08 307/32 |
| 2019/0239298 | A1 * | 8/2019 | Bruckner | H05B 45/37 |
| 2020/0214097 | A1 * | 7/2020 | Qiu | H05B 45/46 |

* cited by examiner

*Primary Examiner* — Muhammad N Edun
(74) *Attorney, Agent, or Firm* — Novick, Kim & Lee, PLLC; Allen Xue

(57) ABSTRACT

An LED display system includes a driver chip and an LED array having m scan lines, n channels, and m scan switches. The driver chip includes an analog circuit and a digital controller that controls the analog circuit. The analog circuit has a plurality of power sources that are electrically connected to the LED array and provide a plurality of driving currents to the n channels of LEDs. Further, the n channels are divided into p groups and each group has q channels, p is an integer of 2 to n. Channels in each of the p groups receive a plurality of PWM signals. The starting times of the input PWM signals to at least two different groups among the p groups are different. Further, PMW signals to the channels in the same group may have a same starting time or may have different starting times.

15 Claims, 5 Drawing Sheets

METHOD AND APPARATUS FOR REDUCING LED PANEL INTER-CHANNEL INTERFERENCE

BACKGROUND

1. Field of Technology

This disclosure relates to the field of LED panel, specifically to method and apparatus for reducing inter-channel interference in the LED panel.

2. Description of Related Art

An LED driver controls an LED array via scan lines, e.g., by turning ON or OFF scan switches. The illustrative example in FIG. 1 shows a common cathode topology of an LED array of m by n pixels in size. In this example, m scan lines connect the analog driver on the driver chip to the LED array. Each scan line connects n RGB pixels and is connected to one scan switch (sw) that can turn the scan line ON or OFF electrically. Meanwhile, each of the 3×n channels (Ib[1:n], Ig[1:n], Ir[1:n]) connects m R, G, or B pixels to a power source on the analog driver. The control signals, including timings of various PWM signals, are generated in a digital controller and sent to the analog driver. The analog driver in turn generates, among others, various current signals to drive the LED array. Examples of driver chip configurations, e.g., LED array having a common cathode topology, or a common anode topology can be found in U.S. Pat. Nos. 8,963,810 and 8,963,811.

The driving signals to the channels are PWM signals of various lengths, i.e., various ON durations. All PWM signals are confined within a fixed time period during which the driving current pulses for different channels start simultaneously, stay ON for various durations, and end at various time points. FIG. 2 illustrates such a control scheme.

Although the driving scheme in FIG. 2 is simple, it suffers from inter-channel interference, which deteriorates image quality. Inter-channel interference can be due to a transient effect caused by sudden current change. For example, it may result from disturbances in the power line and ground when multiple channels are turned on simultaneously, causing a sudden demand of power and destabilizing the power line and ground. Inter-channel interference may also result from voltage coupling through the LED loading network as LEDs have intrinsic and parasitic capacitances. Inter-channel interference may also come from the driving circuit inside the chip since different output channels may share the same biasing circuit. One of the effects of inter-channel interference may be that the brightness of a same pixel in response to the same input data may be brighter when more LEDs on the same scan line are ON than when fewer LEDs on the same scan line are ON. Such inconsistencies deteriorate image quality, especially when the input data is low and output light intensity is low.

Accordingly, there is a need for new apparatus and methods for to minimize the inter-channel interference.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

In one embodiment of the current disclosure, the LED array are arranged to have m scan lines and n channels. Each of the scan line is connected to a scan switch and each channel is connected to a power source. The method for driving an LED array includes the step of dividing the n channels into p groups, each of the p groups has q channels, wherein n=p×q; and inputting a plurality of PWM signals into the p groups so that every channels in each group receives a PWM signal. Further, at least two among the plurality of PWM signals have different starting times. The value of p can be an integer of 2 to n. Further, $t_{sw}$ is a time period during which one scan switch is ON, while p number of time slots are arranged sequentially in one $t_{sw}$.

In one of the embodiments, among the p number of time slots, a first time slot and a second time slot are adjacent to each other and the first time slot and the second time slot do not overlap.

In another embodiment, q equals one or an integer larger than one.

When q equals an integer larger than one, each of the p number of time slots is further divided into two or more sub-segments, and two adjacent sub-segments have a difference between starting times thereof. Each of the q channels receives a PWM signal in one of the two or more sub-segments.

In a further embodiment, among the p number of time slots, a first time slot and a second time slot overlap. The first time slot has The first starting time, a second time slot has a second starting time, and a difference between the first starting time and the second starting time is dt.

In one specific embodiment, dt satisfies to the following equation $$(n-1)\times dt+t_{max}<t_{sw},$$

in which $t_{max}$ is a predetermined value for PWM signal duration in one scan. For example, $t_{max}$ is determined according to a maximum design output luminance of the LED array.

In a further embodiment, q is an integer larger than one, and each of the q channels in one of the p groups receives a PWM signal in a same time slot amongst the p number of time slots.

This disclosure also provides an LED display system. The LED display system includes a driver chip and an LED array having m scan lines, n channels, and m scan switches. Each scan switch is electrically connected to one of them scan lines. The driver chip includes an analog circuit and a digital controller that controls the analog circuit. The analog circuit has a plurality of power sources that are electrically connected to the LED array and provides a plurality of driving currents to the n channels of LEDs according a plurality of PWM signals from the digital controller. Further, the n channels are divided into p groups and each group has q channels. p is an integer of 2 to n. Channels in each of the p groups receive a plurality of PWM signals. The starting times of the input PWM signals to two different groups among the p groups are different. Further, input PMW signals to the channels in the same group may have a same starting time or may have different starting times.

Other features and aspects will be apparent from the following detailed description, the drawings, and the claims.

Figure 1:
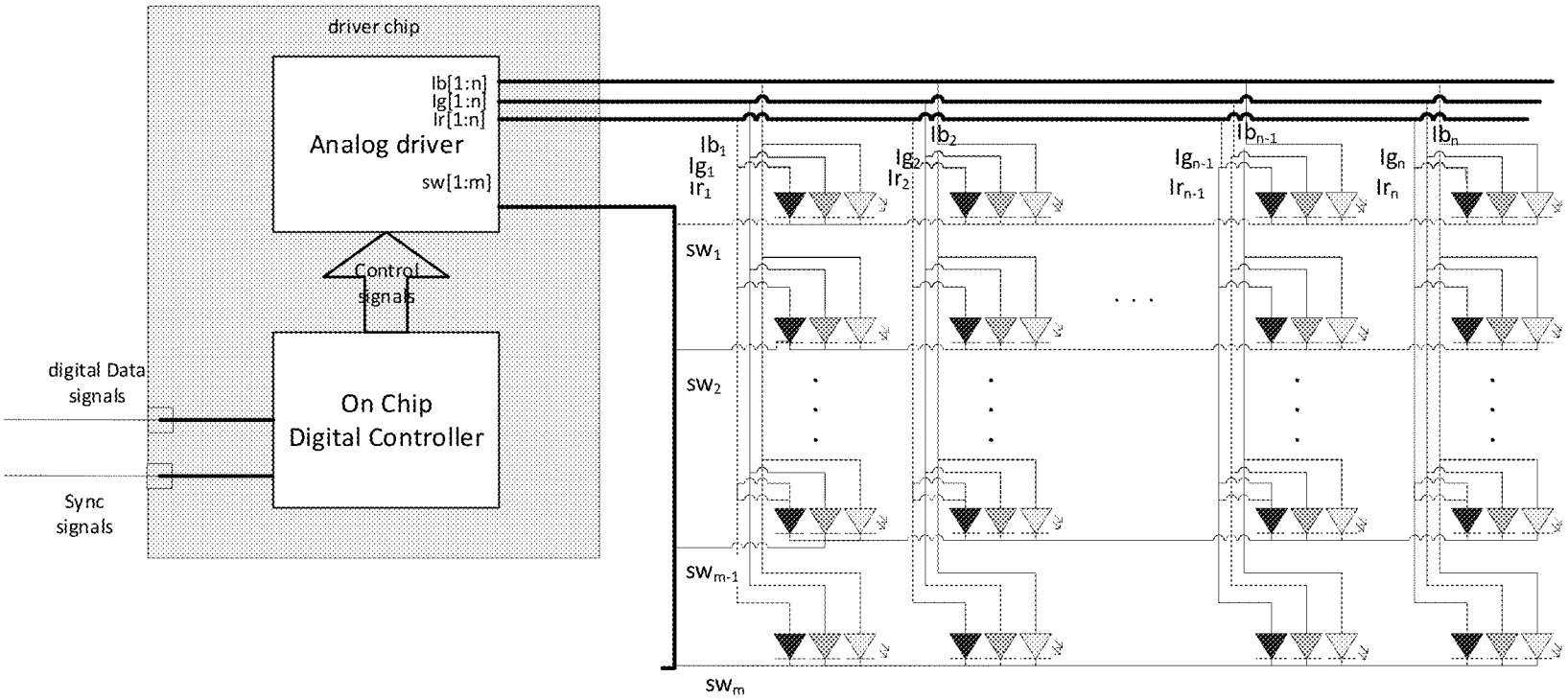
FIG. 1 illustrates an LED panel system having a driver chip driving an LED array arranged in a common cathode configuration.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses, and/or methods described herein will be apparent to one of ordinary skill in the art. For example, it is understood that inputting a PWM signal to an LED, or an LED channel means providing a driving current that is controlled by the PWM signal. Such a driving method is implemented using a digital controller that generates the PWM signal and an analog circuit that has a power source that generates a driving current in response to the PWM signal.

The features described herein may be embodied in different forms and are not to be construed as being limited to the examples described herein. Rather, the examples described herein have been provided so that this disclosure will be thorough and complete, and will convey the full scope of the disclosure to one of ordinary skill in the art.

Figure 2:
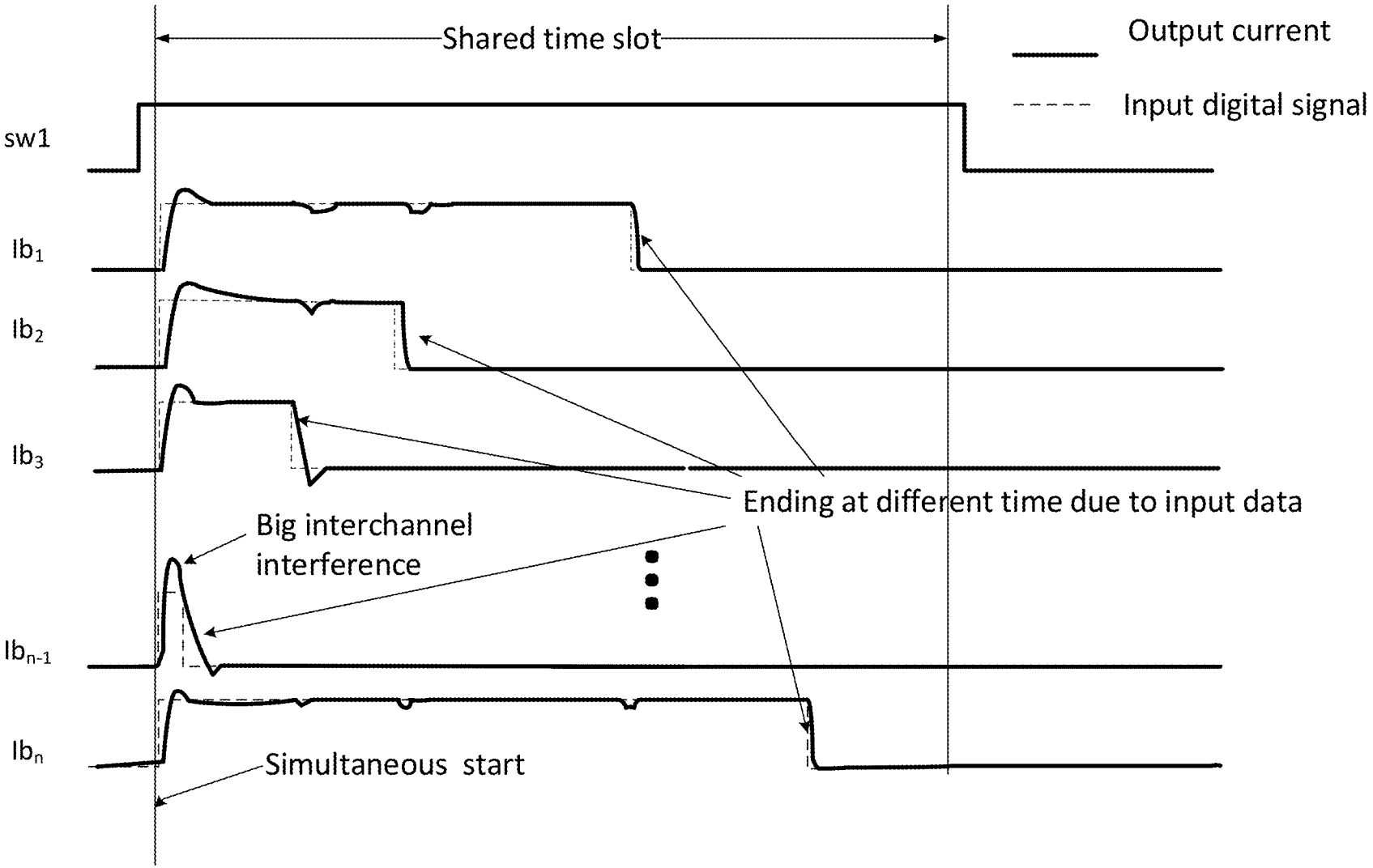
FIG. 2 is a diagram showing PWM signals that drives the blue LED channels (numbers 1 to n) in the LED array and the corresponding output currents in each channel.
Figure 3:
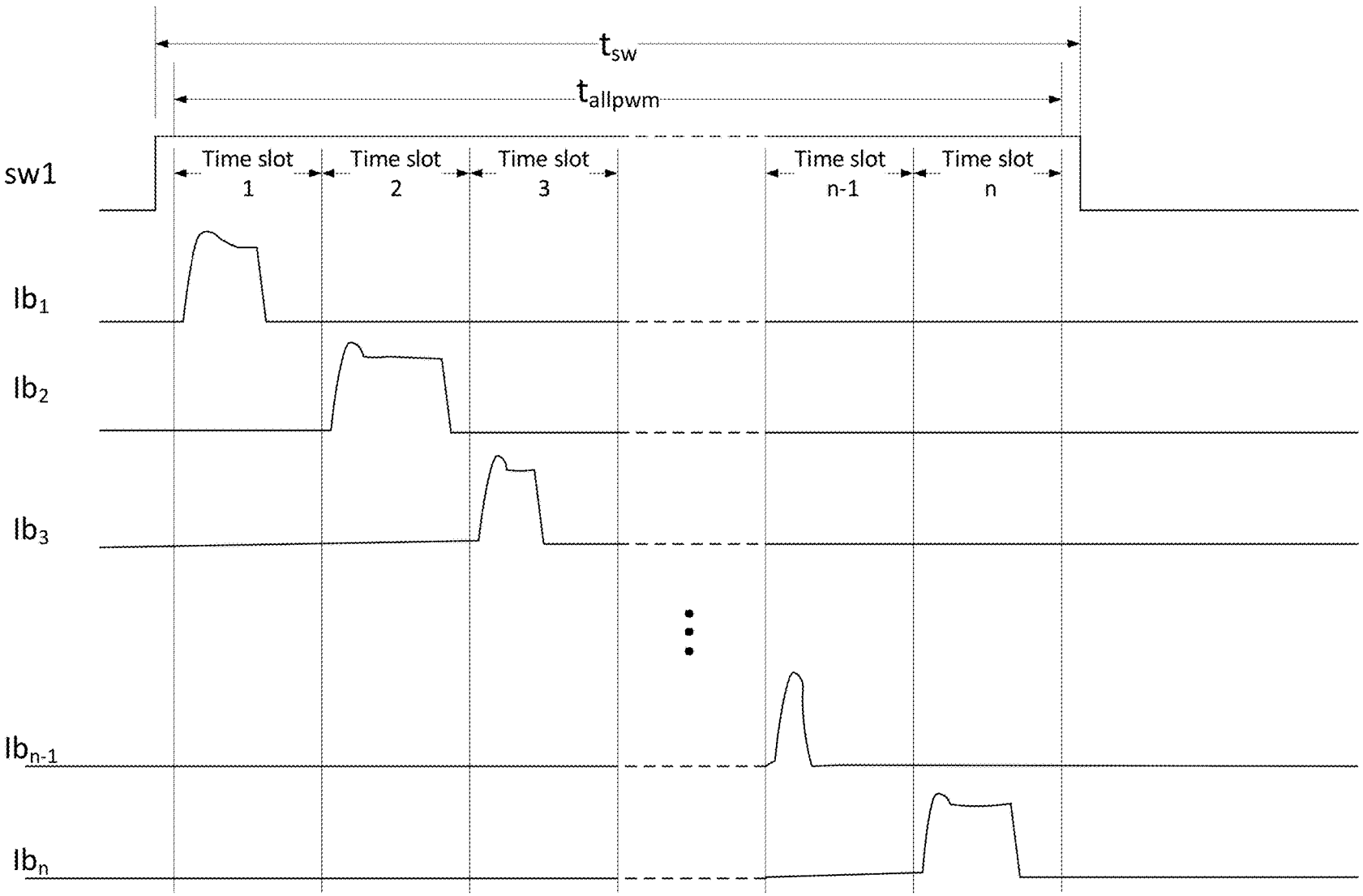
FIG. 3 is a diagram illustrating a first driving method according to a first embodiment in this disclosure.

FIG. 3 is a timing diagram that illustrates the first embodiment in this disclosure, aka "sequencing." In FIG. 3, $t_{sw}$ represents the duration when a certain scan switch amongst $SW_1$ to $SW_m$ is ON. $t_{allpwm}$ is the sum of all time slots (i.e., time slot 1 to time slot n) allotted for all the PWM signals during one complete scan of all n channels, e.g., Ib[1:n], Ig[1:n], or Ir[1:n]. In this embodiment, $t_{sw}$ is larger than the $t_{allpwm}$ to ensure the LED receives the PWM signal after the switch is settled to a stable state after being turned ON. Differing from the driving method shown in FIG. 2, which starts the PWM signals for all n channels simultaneously, each of the channel 1 to channel n in FIG. 3 receives a PWM signal in its own allotted time slot. As such, each channel can be turned ON at a time that differs from the starting time of another channel.

In the first embodiment shown in FIG. 3, since two different channels are not turned ON at the same time, these two channels may not interfere with each other. On the other hand, as each time slot in FIG. 3 is only a fraction of $t_{sw}$, the LEDs in that channel is lit during a fraction of $t_{sw}$ so the output luminance level is low. In contrast, the m LEDs in each channel may be lit up to the full length of $t_{sw}$ in the driving method shown in FIG. 2. Consequently, an LED display driven according to the first embodiment may not have the same output luminance level as when it is driven according to FIG. 2. In other words, a higher current level is required in the first embodiment shown in FIG. 3 to reach the same output luminance level as the traditional driving scheme shown in FIG. 2 would require.

In the second embodiment, aka "grouping," n channels are divided into a plurality of groups. The channels in different groups receive PWM signals at different starting points while channels in a same group receive PWM at the same time. For example, n output channels are divided into p groups, each having q channels, i.e., n=p×q. The total scan time $t_{sw}$ is divided into p number of time slots. All channels in the same group receive PWM signals in the same time slot at the same time while two different groups among the p groups are turned on at two different times in two different time slots.

Figure 4:
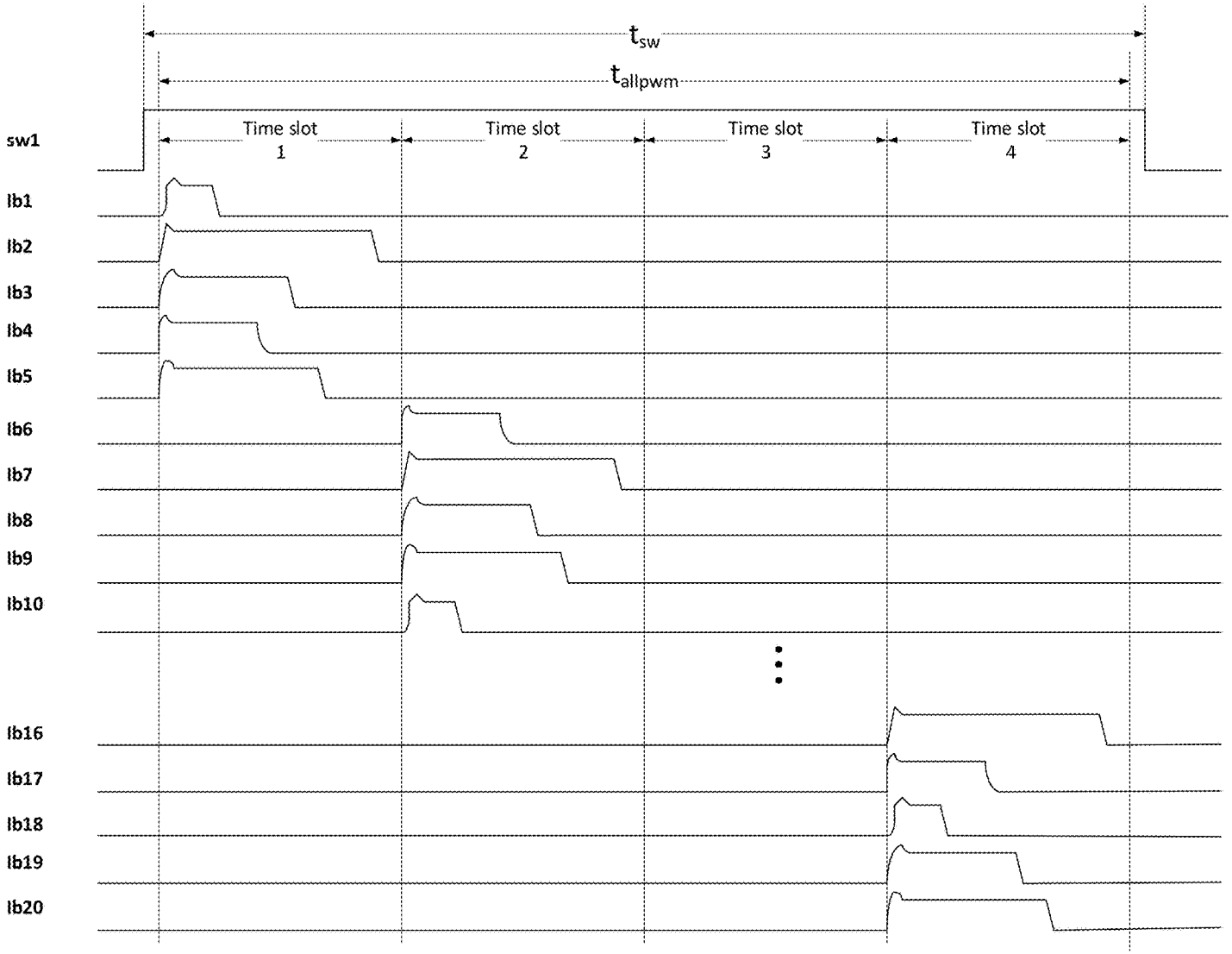
FIG. 4 is a diagram illustrating a second driving method according to a second embodiment in this disclosure.

As shown in the exemplary embodiment in FIG. 4, a total of twenty channels (n=20) are divided into four groups (p=4) of five channels each (q=5). Channels within a group receives the PWM signals simultaneously and are turned on in the same time slot. Each of the four different groups of channels are turned on in time slots 1, 2, 3, or 4. As such, five channels of LEDs (i.e., 5n of LEDs) may be ON in one time slot so that the LED array may appear brighter. Put in another way, when applying the driving method of the first embodiment (FIG. 3) and the driving method of the second embodiment (FIG. 4) to the same LED array, the second embodiment has a smaller number of time slots but each time slot has a longer duration. E.g., each time slot in FIG. 4 is five times the duration of the time slot in FIG. 3. Accordingly, the LED array is lit for a longer duration in the second embodiment so that a lower input current may achieve the same level of luminance as that of the first embodiment.

Figure 5:
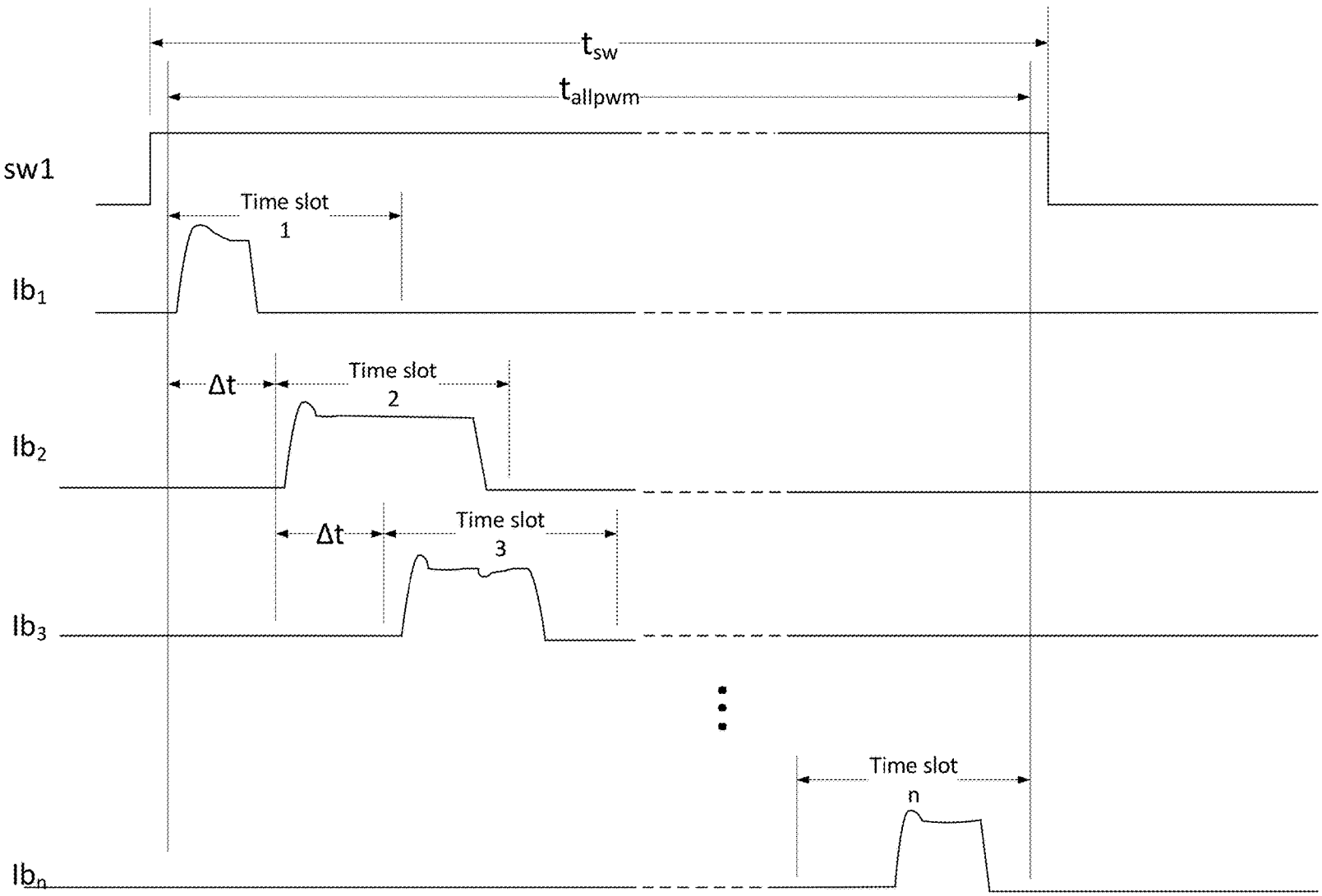
FIG. 5 is a diagram illustrating a third driving method according to a third embodiment in this disclosure.

In the third embodiment, aka "delaying," the starting times of the various input PWM signals to the n LED channels are sequentially delayed. As shown in FIG. 5, the time delay between two consecutive time slots is Δt. Such a delay (or shift) separates the rising edges of different PWM signals. When Δt is larger than the settling time of the output light signal and/or the current received by the LED, the light and/or current in the previous channel is already stable before the subsequent channel is turned ON so that ON/OFF events in neighboring channels in the same LED array do not cause a significant disruption on the LEDs that are lit. As such, sources of transient disturbances are limited to LEDs within the same channel so that disturbances from multiple channels do not aggregate to cause larger disturbances.

The falling edge of the proceeding current may also interfere with the channels being turned ON subsequently. However, the interference is limited to the immediate subsequent ON channel that has a relatively short ON period (i.e., low data input). For channels having a long pulse width (i.e., high data input), the interference is relatively small as the short disturbance is masked by the designated long pulse width. Accordingly, a large Δt lowers the possibility that consecutive PWM signals would cause interference between two channels lit consecutively.

Δt can be estimated according to Equation 1 below:

$$(n-1)\times\Delta t + t_{max} = t_{allpwm} < t_{sw} = \frac{t_{refresh}}{m} \quad \text{Eq. 1}$$

n—channel number or number of channels;

Δt—time difference between the starting times of two consecutive time slots;

$t_{max}$—maximum PWM signal duration in one scan according to design specification;

$t_{sw}$—scan time;

$t_{refresh}$ display refresh time;

m—scan number or number of scan lines.

$t_{max}$ is the maximum signal duration in one scan the LED display is designed for, which corresponds to the maximum design brightness a particular LED array is designed for. Note that an LED display that has 16-bit gray scale has a maximum data width of 65535, which corresponds to the maximum brightness of the LED display is capable to deliver. The output brightness corresponds to the duration of PWM signals the LED display receives at any moment, which is usually a fraction of the maximum brightness capacity of the LED display. $t_{max}$ is determined once the maximum design brightness and other parameters (e.g., scan number, refresh time, LED efficiency, driving current to the LEDs) are determined. Equation 1 can be used to calculate the highest value of Δt. On the other hand, when the input data reaches its maximum possible PWM value (e.g., 65535 for 16-bit PWM), $t_{max}$ is the corresponding ON time during one scan for one channel. For example, when the refresh rate ($1/t_{refresh}$) is 720 Hz, scan number (m) is 32, channel number (n) is 40, $t_{sw}$ calculated according to Equation 1 is 43 μs. When $t_{max}$=32μ, Δt=300 ns, i.e., (43 μs−32 μs)/(40−1)=300 ns. It indicates that, when the maximum design brightness of the LED display requires $t_{max}$ to be 32 μs, the maximum time delay between two consecutive time slots is 300 ns. In such a matter, Equation 1 may be used to calculated the largest Δt allowable.

In the first embodiment and the second embodiment, time slots do not overlap. In contrast, in the third embodiment of FIG. 5, the time slots are staggered so that more time slots can be assigned in one $t_{sw}$. As such, the third embodiment enables a longer $t_{max}$ than that of the first embodiment.

The first embodiment ("sequencing") can be viewed as a special case in the third embodiment ("delay") when Δt equals the length of one time slot.

Other embodiments may integrate "grouping" and "delaying" in several different ways. In one of the embodiments, p groups of LED channels are sequentially turned ON. The LEDs in the same group has the same starting time. On the other hand, Δt' is the time difference between the starting times of two consecutive groups LED channels in the driving sequence. Likewise, Δt' is limited by the relation shown in Equation 2.

$$(p-1)\times\Delta t'+t_{max}=t_{allpwm}<t_{sw} \quad \text{Eq. 2}$$

In this embodiment, the starting time for the second LED channel onward to receive PWM signals is delayed by Δt' so that the total delay time of p groups is (p−1)×Δt'. Likewise, when Δt' equals the length of one time slot, this embodiment is the same as the second embodiment ("grouping").

In a further embodiment, in addition to delays (Δt') amongst the groups of LED channels, each LED channel in the same group may be turned ON with a delay of Δt'', Δt'' being different from Δt'. This embodiment provides two parameters that can be used to optimize the brightness and to reduce inter-channel interference in the LED display.

In this disclosure, a large LED array refers to an LED array with a large of LEDs, e.g., when the channel number n is 40 or larger, for example, 80, 120, or 200. The large LED array can be a large wall display or a small but ultrahigh resolution device, e.g., a handheld device. Such a large LED array may be further divided into different zones. Each zone has a sub-array of LEDs. The sub-arrays in different zones may adopt the "sequencing" driving method of the first embodiment, the "grouping" driving method of the second embodiment, the "delaying" driving method or the third embodiment, or a combination thereof.

In addition, the driving methods disclosed above are applicable to LED arrays having a common cathode topology or a common anode topology.

Therefore, the scope of the disclosure is defined not by the detailed description, but by the claims and their equivalents, and all variations within the scope of the claims and their equivalents are to be construed as being included in the disclosure.

What is claimed is:

1. A method for driving an LED array, wherein the LED array comprises m scan lines, n channels, and m×n number of LED pixels, the method comprising:

dividing the n channels into p groups, each of the p groups has q channels, wherein n=p×q; and inputting a plurality of PWM signals into the p groups so that each group receives one or more PWM signals, wherein at least two among the plurality of PWM signals have different starting times, wherein each scan line connects n LED pixels, each of the n LED pixels is disposed in one of the n channels, wherein each channel connects m LED pixels, each of the m LED pixels is disposed in one of the m scan lines, and wherein n and m are integers larger than one.

2. The method of claim 1, wherein p is an integer ranging from 2 to n.

3. The method of claim 2, wherein the LED array comprises m scan switches, each scan switch is electrically connected to one of the m scan lines, and $t_{sw}$ is a time period during which one scan switch is ON, wherein p number of time slots are arranged sequentially in one $t_{sw}$.

4. The method of claim 3, wherein, among the p number of time slots, a first time slot and a second time slot are adjacent to each other and the first time slot and the second time slot do not overlap.

5. The method of claim 4, wherein q equals one or an integer larger than one.

6. The method of claim 5, wherein q equals an integer larger than one, further comprising dividing each of the p number of time slots into two or more sub-segments, and two adjacent sub-segments have a difference between starting times thereof, wherein each of the q channels receives a PWM signal in one of the two or more sub-segments.

7. The method of claim 3, wherein, among the p number of time slots, a first time slot and a second slot overlap, wherein the first time slot has a first starting time, the second time slot has a second starting time, and a difference between the first starting time and the second starting time is dt.

8. The method of claim 7, further comprising obtaining dt according to the following equation $$(n-1)\times dt+t_{max}<t_{sw},$$

wherein $t_{max}$ is a predetermined value for PWM signal duration in one scan.

9. The method of claim 8, wherein $t_{max}$ is determined according to a maximum design output luminance of the LED array.

10. The method of claim 7, wherein q equals one.

11. The method of claim 7, wherein, when q is an integer larger than one, each of the q channels in one of the p groups receive a PWM signal in a same time slot amongst the p number of time slots, and wherein each scan line connects n LED pixels, each of the n LED pixels is disposed in one of the n channels, wherein each channel connects m LED pixels, each of the m LED pixels is disposed in one of the m scan lines.

12. An LED display system, comprising a driver chip and an LED array having m scan lines, n channels, and m scan switches, and n×m number of LED pixels, wherein:

each scan line connects n LED pixels, each of the n LED pixels is disposed in one of the n channels, each channel connects m LED pixels, each of the m LED pixels is disposed in one of the m scan lines, each scan switch is electrically connected to one of the m scan lines, and n and m are integers larger than one, the driver chip comprises an analog circuit and a digital controller that controls the analog circuit, the analog circuit comprises a plurality of power sources that are electrically connected to the LED array and provide a plurality of driving currents to the n channels of LED pixels according a plurality of PWM signals from the digital controller, n channels are divided into p groups and each group has q channels, p is an integer of 2 to n, all q channels in a same group are connected to a same power source among the plurality of power sources, and, during operation, at least two among the plurality of PWM signals have different starting times.

13. The LED display system of claim 12, wherein $t_{sw}$ is a time period during which one scan switch is ON, wherein p number of time slots are arranged sequentially in one $t_{sw}$, among the p number of time slots, a first time slot and a second time slot are adjacent to each other and the first time slot and the second time slot do not overlap.

14. The LED display system of claim 12, wherein $t_{sw}$ is a time period during which one scan switch is ON, wherein p number of time slots are arranged sequentially in one $t_{sw}$, among the p number of time slots, a first segment and a second segment overlap, wherein a first time slot has a first starting time, a second time slot has a second starting time, and a difference between the first starting time and the second starting time is dt.

15. The LED display system of claim 14, further comprising obtaining dt according to the following equation $(n-1)\times dt+t_{max}<t_{sw}$, wherein $t_{max}$ is a predetermined value for PWM signal duration in one scan.

* * * * *